United States Patent [19]

Diamond et al.

[11] Patent Number: 4,946,292

[45] Date of Patent: Aug. 7, 1990

[54] BAG HAVING EXPANDING MEANS THEREIN

[75] Inventors: Sidney Diamond, 3800 North Lake Shore Drive, Apt 11-B, Chicago, Ill. 60613; Deborah L. Diamond, Northbrook, Ill.

[73] Assignee: Sidney Diamond, Niles, Ill.

[21] Appl. No.: 367,759

[22] Filed: Jun. 19, 1989

[51] Int. Cl.[5] ..... A45C 7/00

[52] U.S. Cl. ..... 383/127; 190/106; 383/33

[58] Field of Search ..... 383/33, 35, 104, 119, 383/127, 2; 190/103, 107, 106, 105; 248/166, 174, 440.1, 459, 460, 464; 206/805

[56] References Cited

U.S. PATENT DOCUMENTS

| | | | |
|---|---|---|---|
| 1,745,947 | 2/1930 | Mustin | 206/805 X |
| 2,798,579 | 7/1957 | Fox | 190/107 X |
| 2,930,557 | 3/1960 | Richards | 206/805 X |
| 3,017,148 | 1/1962 | Wathen | 248/459 |
| 3,119,194 | 1/1964 | Ray | 248/459 |
| 3,836,104 | 9/1974 | Miller et al. | 248/174 X |
| 4,077,451 | 3/1978 | Zoland | 383/127 |
| 4,141,399 | 2/1979 | Zoland | 383/104 X |
| 4,142,564 | 3/1979 | Zoland | 383/127 |
| 4,434,894 | 3/1984 | Lee | 383/33 X |
| 4,506,823 | 3/1985 | Büchler | 229/928 |

*Primary Examiner*—Bryon P. Gehman
*Attorney, Agent, or Firm*—John S. Pacocha

[57] ABSTRACT

An apparatus for insertion into and expansion of a soft bag or backpack, having a relatively flat foldable member, which is connected to a resilient member or an actuating mechanism. The flat member is folded along at least one transverse axis into at least two sections. The resilient member is connected to the opposed ends of the flat member and urges the ends of the flat member inward from its flat position to a folded position. In the folded position, the flat member forms a gable and pushes the sides of the bag outward to expand the bag. In another form, a cord is used to pull the apparatus into its bag expanding position. Relatively flat inserts may be added to promote uniform expansion of the bag.

15 Claims, 4 Drawing Sheets

BAG HAVING EXPANDING MEANS THEREIN

FIELD OF THE INVENTION

This invention relates to expanding a soft bag or back-pack for display at the point of sale. More particularly, this invention relates to an apparatus which either automatically or manually expands a bag to give the impression that the bag is filled.

BACKGROUND OF THE INVENTION

Soft bags, such as suitcases, tote bags, sports bags, and back-packs, of all sizes and types are presently manufactured throughout the world. The bags are transported from the manufacturer to their destination in a flatly packed or nested state so as to take up minimal shipping space because of the prohibitive costs involved in shipping stuffed bags. Freight charges from the point of manufacture to the destination of the bags are based on the amount of space that the bags occupy. For example, twelve back-packs shipped flat and nested will occupy the same amount of space (approximately one cubic foot) as one stuffed back-pack. As most retailers prefer to sell these bags fully stuffed for marketing purposes, the retailer arranges for the bags to be stuffed and repacked at a stuffing facility located near the final destination or in some instances at the point of sale. The bags are removed from their original shipping cartons at the stuffing facility and stuffing is done manually with such materials as crumpled paper, stiff cardboard pieces or inflated vinyl shapes. The original shipping cartons are disposed of and replaced by larger cartons that will hold the fully stuffed bags.

Stuffing takes time, space and additional personnel, which increases costs, causes inconvenience and sometimes delays delivery of the product to the point of sale. Additionally, the original shipping cartons are not reusable or recyclable and therefore must be discarded through cartage companies, which charge a fee for waste removal and disposal at dump sites. Moreover, additional costs are incurred for the new larger cartons and additional freight charges are incurred for shipping the new cartons containing the stuffed bags to the retailer after the stuffing process is completed.

The retailer also confronts storage problems as the stuffed bags take up much more storage space than unstuffed bags. Accordingly, the retailer is inclined to order limited quantities of stuffed bags because of storage restrictions, and thereby is subject to the risk of a rapidly depleting inventory and being unable to reorder in time to fill the demand.

As a result of the problems associated with manually stuffed bags, some retailers have opted to display their bags flat and include a picture of the bag as it appears stuffed. This method, however, is also costly and precludes the consumer from viewing the actual stuffed bag. Other retailers have contemplated having bags stuffed at the manufacturing point, but this is uneconomical because it requires more shipping space so that less bags can be shipped per container causing greatly increased shipping costs.

Accordingly, an object of the present invention is to provide an insertable apparatus that permits a bag to be retained in a flattened state until expansion is desired and then allows the bag to be easily and quickly expanded by the retailer when the retailer desires to display the bag.

Another object of the present invention is to provide an insertable apparatus that is placed in the bag by the manufacturer or at the place of manufacture and is thereby more efficient and cost-effective since it allows the bag to be sent directly to the retailer, rather than a stuffing facility, thus precluding delays in delivery time.

Another object of the present invention is to provide an insertable apparatus that requires minimum material to manufacture and greatly reduces and conserves the usage of paper products or other stuffing materials, as well as the disposal of those materials.

Another object of the present invention is to provide an insertable apparatus that is placed in the bag during manufacture, sent to the retailer in the original shipping container, and thereby reduces freight charges and eliminates the need for an additional larger shipping container to house the stuffed bags.

Another object of the present invention is to provide an insertable apparatus for bags that requires a minimal amount of additional space in the shipping container and thereby enables retailers to order larger quantities and avoid inventory depletion.

A further object of the present invention is to provide an insertable apparatus that is relatively inexpensive to manufacture and can be imprinted with advertising or other information directed to purchasers of the bag.

Additional objects and advantages will become apparent from the following description and the drawings.

SUMMARY OF THE INVENTION

The present invention comprises an apparatus having a relatively flat and foldable member, which is connected to a resilient member or an actuating means. The flat member can be constructed of a generally rectangular piece of cardboard, corrugated board, or other suitable material, which is provided with at least one transverse foldline that divides the board into at least two sections. The board can be folded along the foldline to urge the two sections toward one another. The resilient member or actuating means can be a rubber band which is connected to the opposed ends of the flat member in substantially perpendicular relation to the foldline or axis about which the flat member is folded.

When the flat member is in its unfolded position, the rubber band is stretched. The memory of the resilient member thereby causes it to urge the ends of the flat member inward and this in turn causes the member to move into its folded position. Thus, the flat member will only remain in its unfolded position if a weight or some other external force is applied to it. When this apparatus is placed in a bag and no force is applied to the bag to retain the flat member in a flattened state, the member moves into its folded position, forms a gable, and pushes the sides of the bag outward to expand the bag. To insure more uniform expansion of the bag, generally rigid inserts, made of cardboard or other suitable material, may be added to the inventive apparatus. The inserts are placed on each side of the flat member in parallel relation thereto. When the flat member is folded into a gable it pushes against the cardboard inserts, which in turn push outwardly against the side of the bag. Since the inserts are preferably shaped to the dimensions of the sides of the bag, they will cause the bag to uniformly expand.

At the point of sale, the bag will automatically expand when it is removed from the shipping carton and the external force is removed from it. This saves time and promotes uniform expansion of each bag.

In another embodiment of this invention the flat member comprises three sections arranged in tandem: an elongated first section, a second section foldably attached to one end of the first section, and a third section foldably attached to the end of the second section which is opposite the end attached to the first section. The second and third sections are connected together with a resilient member, which is attached adjacent the ends of the sections and urges the sections toward one another in a manner similar to the first embodiment described earlier. An alternative of this embodiment employs an actuating means, such as a string, tape, or other suitable item, to pull the second and third sections toward one another. The string attaches to one end of the third section, passes through an aperture near the opposite end of the second section, and extends outside the mouth of the bag in which the apparatus of this invention is inserted. When expansion of the bag is desired, one may simply pull on the string. This in turn pulls the third section in the direction of the pulling force and causes the second and third sections to fold about the foldline dividing them and form a gable. The gable pushes the bag sides apart, causes air to be drawn into the bag, and thereby expands the bag. In both embodiments, a tab on the end of the third section may be provided for insertion into a slot on the first section when the structure is in its gabled bag-expanding position. This tab and slot arrangement provides stability to the structure. Also, if several slots are used the height of the gable may be adjusted to accommodate different sized bags. Similar to the first embodiment, additional flat inserts can be used with the apparatus to promote more uniform expansion of the bag.

The inventive apparatus can be easily inserted into the bags at the point of manufacture. When the resilient member is used, the bag can be shipped closed. When the string is used, a slight opening in the bag mouth is preferable, through which the string may extend. When the inventive apparatus is used, the bags need not be shipped to a stuffing facility near their final destination, thereby saving labor, stuffing and repacking costs, and eliminating delays in delivery and material waste. Since the bags containing the inventive device can be shipped flat, there is no appreciable increase in freight costs or the size of the shipping container. Moreover, the inventive device saves paper since less material would generally be used in the inventive device as compared with the material used in manually stuffing of the bags. The inventive device also eliminates the need for repacking and placing the bags into a second larger shipping container.

Because soft bags come in different sizes, shapes, and material thicknesses, the inventive apparatus can be varied to accommodate these differences. The flat member may be constructed in different lengths, widths, shapes, and strengths including elliptical, rectangular, or irregular shapes, to conform to the shape of the bag.

DETAILED DESCRIPTION OF THE INVENTION

Figure 1:
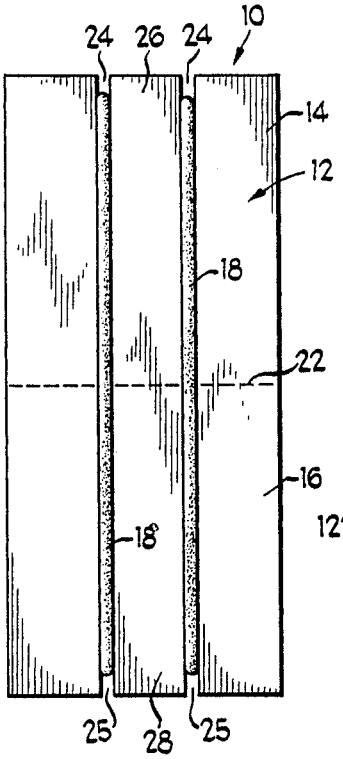
FIG. 1 is a bottom plan view of one embodiment of the invention, showing it in a flat position prior to insertion in a bag.
Figure 2:
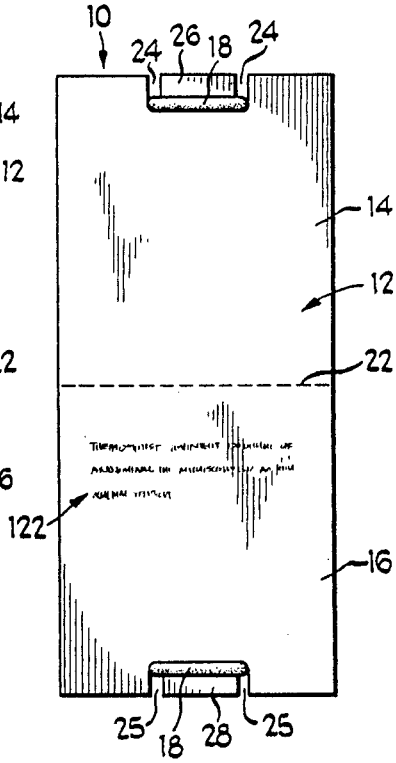
FIG. 2 is a top plan view of the embodiment of FIG. 1.
Figure 3:
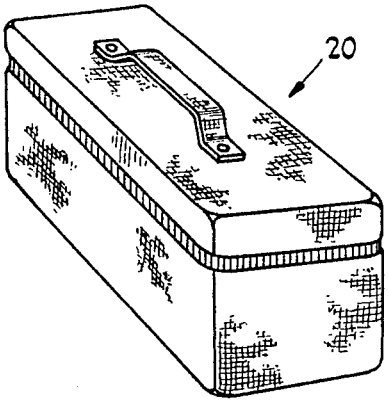
FIG. 3 is a perspective view of an exemplary soft bag.
Figure 4:
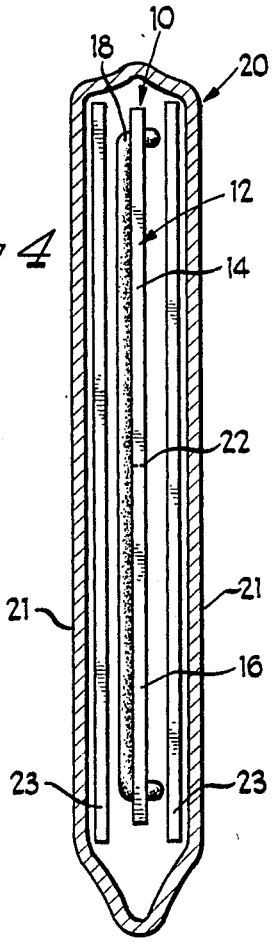
FIG. 4 is a cross-sectional view of the bag of FIG. 3 in a collapsed state, showing the embodiment of FIG. 1 in a flat position inside the bag.
Figure 5:
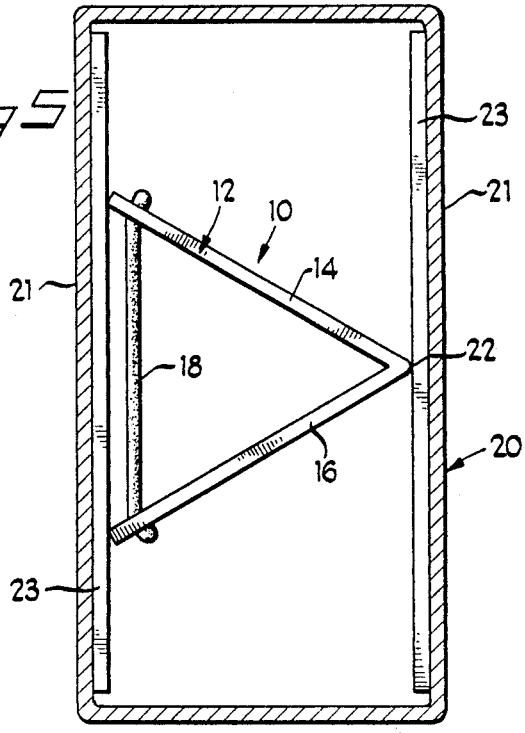
FIG. 5 is a cross-sectional view of the bag of FIG. 3 in an expanded state, showing the embodiment of FIG. 1 in a folded position and expanding the bag.

Referring to FIGS. 1–5, apparatus 10 comprises a generally flat member 12 and a resilient member 18 attached thereto. The flat member can be constructed of cardboard, corrugated board or of other suitable material by die cutting or other suitable manufacturing process. A fold line 22 is provided which divides member 12 into two preferably equal sections, 14, 16 and permits member 12 to be folded along the line, as shown for example in FIG. 5. The resilient member, which can be a rubber band or other elastic means, is attached to the first member by insertion into slots 24, 24 and 25, 25 and looping around tabs 26, 28 (FIGS. 1 and 2). When the member 12 is flat, the resilient member 18 is stretched and under tension. The memory of the member 18 causes it to urge the two sections 14, 16 of first member 12 towards one another. Thus, to keep the member 12 from folding along line 22, it is necessary to exert a force against member 12. When the apparatus 10 is inserted into a soft bag 20, as shown in FIG. 5, resilient member 18 causes sections 14, 16 to move towards one another into a gabled position. This in turn pushes the sides 21 of bag 20 outward and the bag expands. Cardboard inserts 23 may be inserted into bag 20 (see FIG. 4) so that they are parallel to first member 12. When the bag is expanded, as shown, e.g., in FIG. 5, the inserts 23 will aid the bag 20 to expand uniformly.

Preferably, inserts 23 should be shaped and dimensioned to the bags in which they are to be used. This will give the best shape to the bag when it is expanded. The inserts can be eliminated in certain applications, such as small bags, or where the irregularities in shape formed by the absence of the inserts is of no concern to the retailer.

During shipment from the manufacturer to a customer, bag 20 will be placed flat in a container with other bags for shipment to retailers. The container will be completely filled with bags to maximize shipping space so if the bags contain the apparatus of this invention, the apparatus will be in a compressed state, as depicted in FIG. 4. When the bags are removed from the container, the compressive force will be relieved and the sections 14, 16 of apparatus 10 will slowly move towards one another, pushing the walls of the bag outward, as shown in FIG. 5, and giving the bag a filled appearance. To increase the speed of expansion the bag should be opened slightly to allow air into the bag.

FIGS. 6–9 show a second embodiment 11 of the invention, including a generally flat member 30 comprising three sections 32, 34 and 36 and a resilient member 38.

Figure 9:
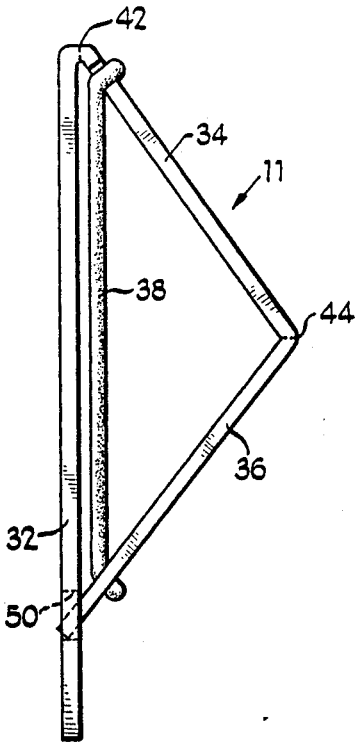
FIG. 9 is a side view of the embodiment of FIG. 6, showing the apparatus arranged in a bag-expanding position with the resilient means in a relaxed position.
Figure 6:
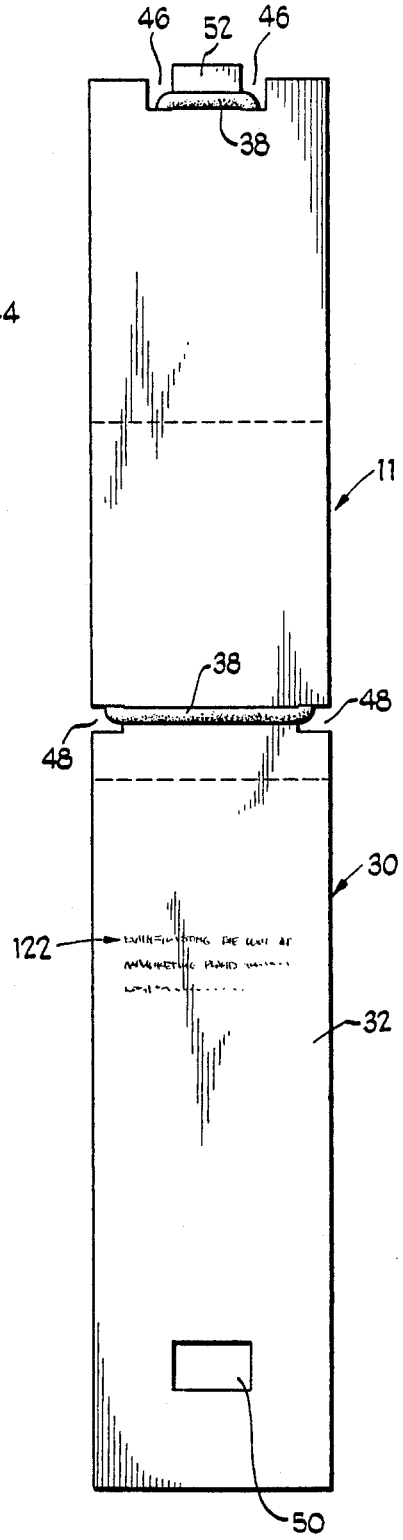
FIG. 6 is a top plan view of a second embodiment of the invention, shown in a flat unfolded position.
Figure 7:
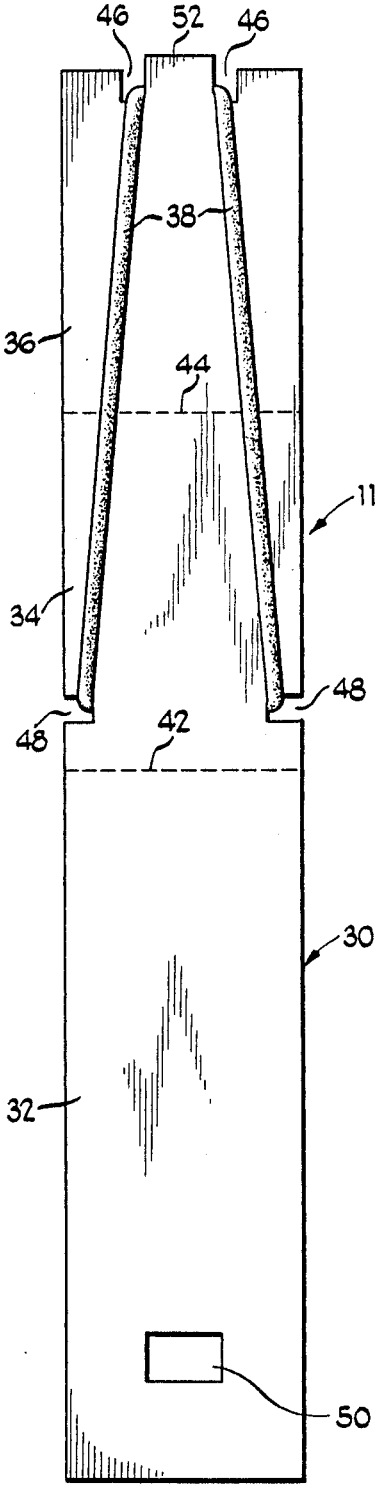
FIG. 7 is a bottom plan view of the embodiment of FIG. 6.
Figure 8:
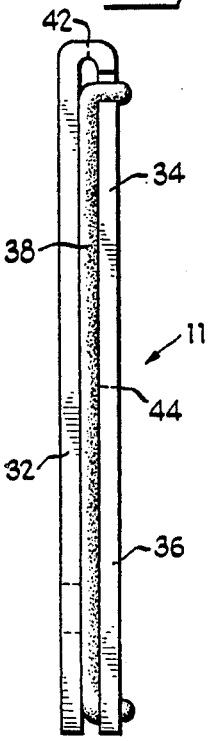
FIG. 8 is a side view of the embodiment of FIG. 6, illustrating the apparatus in a folded position with the resilient means stretched and under tension for insertion into an unexpanded bag.
Figure 12:
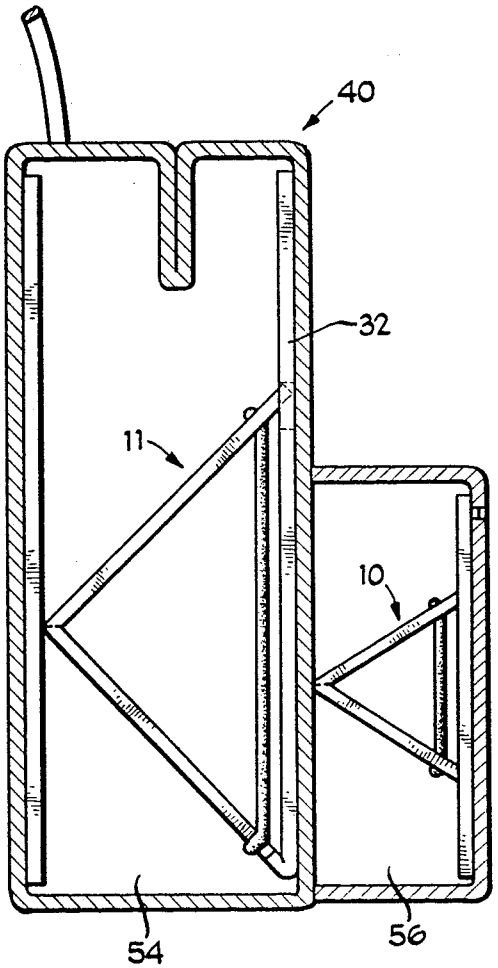
FIG. 12 is a cross-sectional view showing the embodiments of FIGS. 1 and 6, inserted into and expanding the two sections of the back pack.

Sections 32, 34 and 36 are formed by folding member 30 along fold lines 42, 44. Slots 46, 48 are provided in member 30 for retention of member 38, as shown in FIGS. 6 and 7. To prepare the embodiment 11 for use in the bag, the member 30 is folded about foldline 42, as shown in FIG. 8. In this position resilient member 38 is stretched. So long as external pressure is applied to the embodiment 11, it will be retained in the manner shown in FIG. 8. When the pressure is released, the sections 34 and 36 will be pulled together by the resilient member 38 and form a gable, as shown in FIG. 9.

Member 30 includes a slot 50 located on section 32. Slot 50 receives tab 52 located on section 36 and secures sections 34, 36 in the gabled position, shown in FIG. 9. This acts as a locking means and affords greater stability to the structure. As in the first embodiment, cardboard, corrugated board, or other suitable material may be used for member 30, and rubber bands or other suitable elastic means, for member 38.

Figure 11:
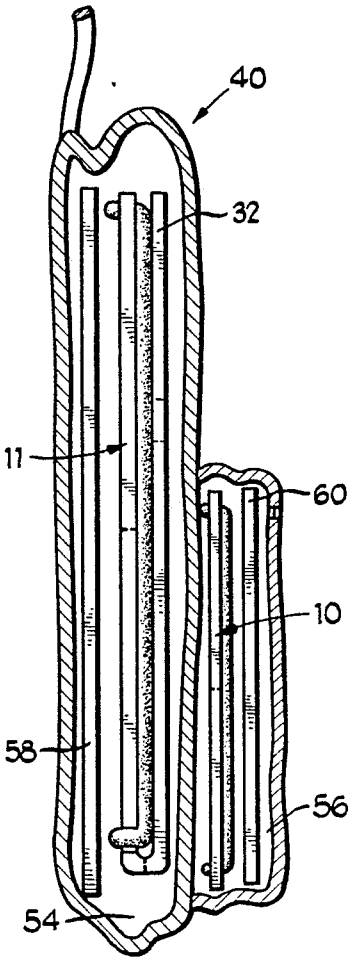
FIG. 11 is a cross-sectional view of the back pack of FIG. 10 in a collapsed state, illustrating the embodiments of FIGS. 1 and 6, inserted in flat positions in the back pack.
Figure 10:
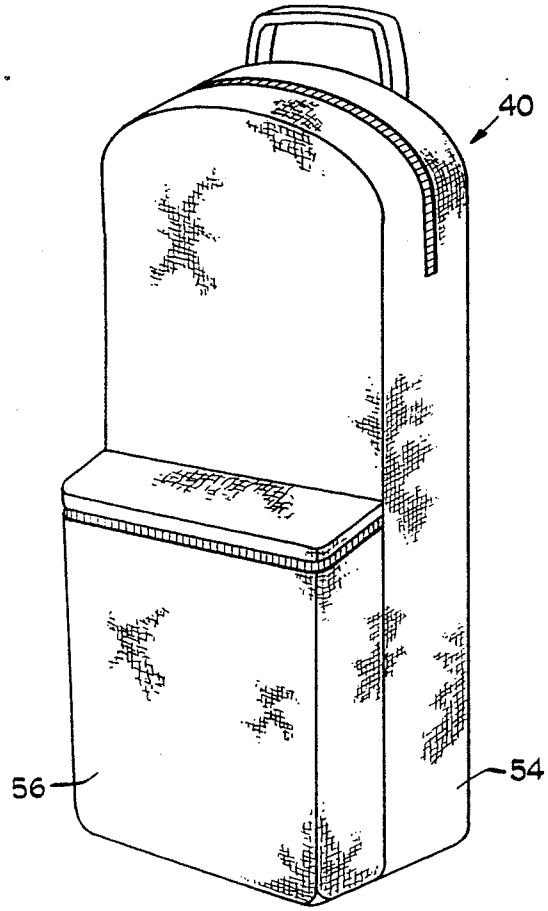
FIG. 10 is a perspective view of a back pack with a pocket.
Figure 13:
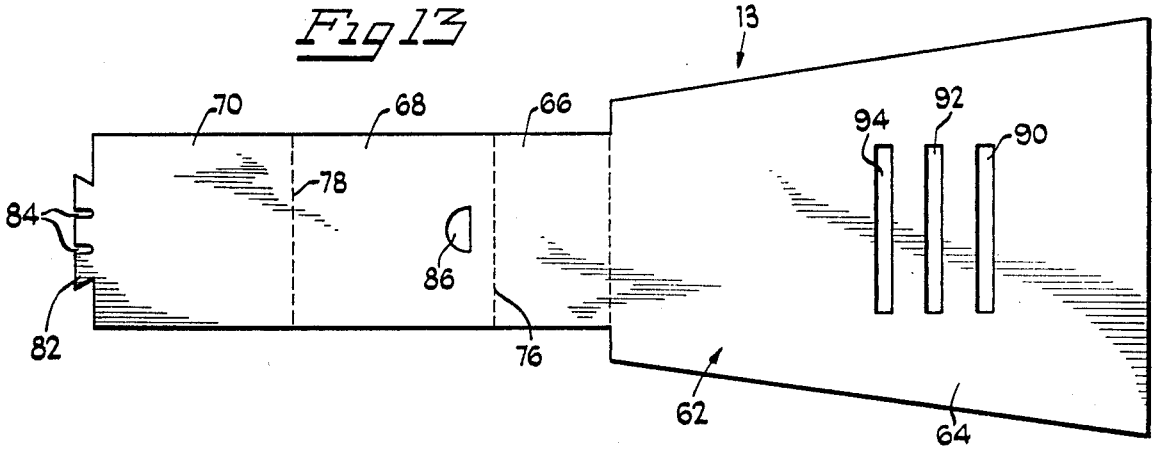
FIG. 13 is a plan view of a third embodiment of the invention, shown in an unfolded position.
Figure 14:
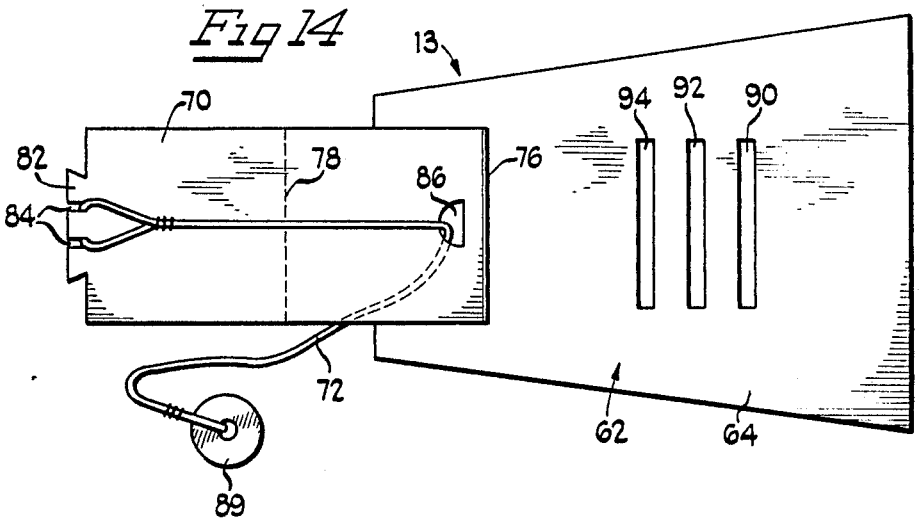
FIG. 14 is a plan view of the embodiment of FIG. 13, showing it in a partially folded position.

FIG. 10 shows a back pack 40 with two separate compartments 54, 56. FIG. 11 shows embodiments 10, 11 as they would appear in a flattened configuration in the compartments 56 and 54, respectively. A single cardboard insert 58 is added to compartment 54, and a single insert 60 is added to compartment 56 of the bag 40. As in the other embodiments, these inserts assist in uniform expansion of bag 40. Because of the three-section configuration of embodiment 11, only one additional insert is necessary. Also, as can be seen in FIG. 11, only one insert is necessary for compartment 56 because section 32 of embodiment 11 accomplishes the function of an insert for that compartment, as well as compartment 54.

FIGS. 13–16 show a third embodiment 13 of the invention. Apparatus 13 has a generally flat member 62 comprising four sections 64, 66, 68 and 70 and actuator member 72, which can be a string, tape, or other suitable device. The actuator member 72 need not be elastic, but should be long enough, so that when apparatus 13 is inserted into a bag, member 72 will extend out from the mouth of the bag.

Figure 15:
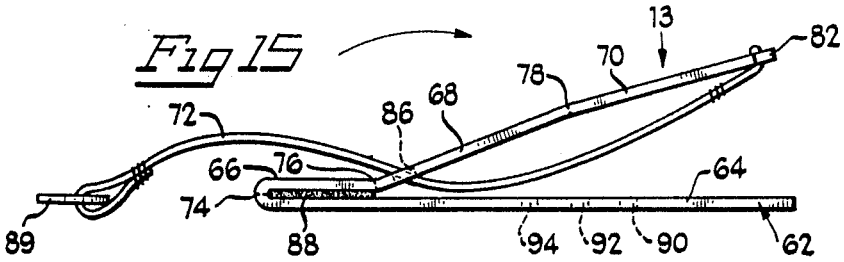
FIG. 15 is a side view of the embodiment of FIG. 13, showing the relative movement of the parts and their relationship to one another just prior to insertion into a bag.
Figure 16:
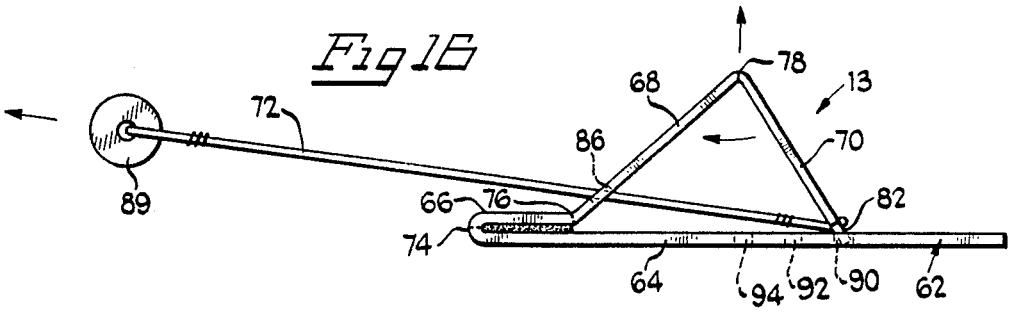
FIG. 16 is a side view of the embodiment of FIG. 13, showing further movement of the parts and their relationship to one another when the apparatus is actuated into its position for expanding a bag.
Figure 17:
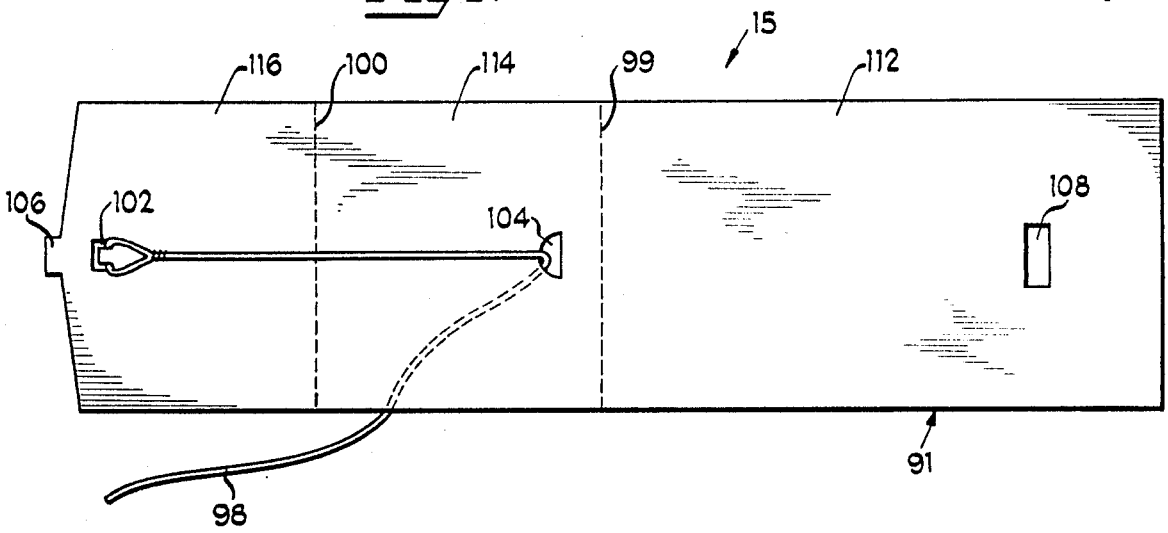
FIG. 17 is a plan view of a fourth embodiment of the invention, showing it in an unfolded position.

The four sections 64, 66, 68, 70 are formed by fold lines 74, 76 and 78, and are adapted to fold over onto section 64 (see, e.g., FIGS. 15 and 16). Section 66 is secured to section 64 at point 88 by an adhesive, adhesive tape, or other suitable fastening means (FIG. 15). Section 64 includes a plurality of slots 90, 92, 94, which are adapted to receive tab 82 of section 70. Tab 82 includes slots 84 which retain member 72 at one end. The remainder of member 72 is threaded through opening 86 in section 68 and terminates in a pull 89.

As shown in FIG. 16, member 72 is manually manipulated to cause sections 68, 70 to move towards one another, while sections 64 and 66 remain in a flat position. As a result of the movement of sections 68, 70, the sides of the bag in which apparatus 13 is inserted into are pushed outward to expand the bag in which the apparatus is inserted. The arrows in FIG. 16 show the inward and upward movement of sections 68, 70 of apparatus 13 as member 72 is pulled in the direction of the arrow. As section 70 slides over section 64, tab 82 of section 70 engages the first of the plurality of slots 90, 92, 94 of section 64. If member 72 is continued to be pulled, the tab 82 will move out of the first slot 90 and into the second one 92. Further pulling on member 72 will cause tab 82 to move to the third slot 94. Insertion of tab 82 into any one of the slots 90, 92, 94 will secure section 70 and stabilize the apparatus 13. By providing a plurality of slots, the height of the gable may be varied, making the apparatus adjustable for bags having different sized gussets. Thus, if greater expansion is desired in the bag, tab 82 can be inserted into the slot 94; if lesser expansion is needed, slot 90 may be employed.

Member 62 of apparatus 13 may be formed from a single piece of material or from two pieces of material. Thus, instead of having fold line 74, apparatus 13 could be formed by securing two separate pieces held together by adhesive 88 or another fastening means.

As noted earlier, actuating member 72 is designed to extend through the mouth and outside of the bag containing apparatus 13. In this application, the bag need only be opened in a manner sufficient to allow member 72 to protrude from the bag. While a pull or handle 89 is provided to facilitate manual manipulation, it is not essential. Instructions for operating the apparatus 13 or other information may be imprinted on the pull 89.

Figure 18:
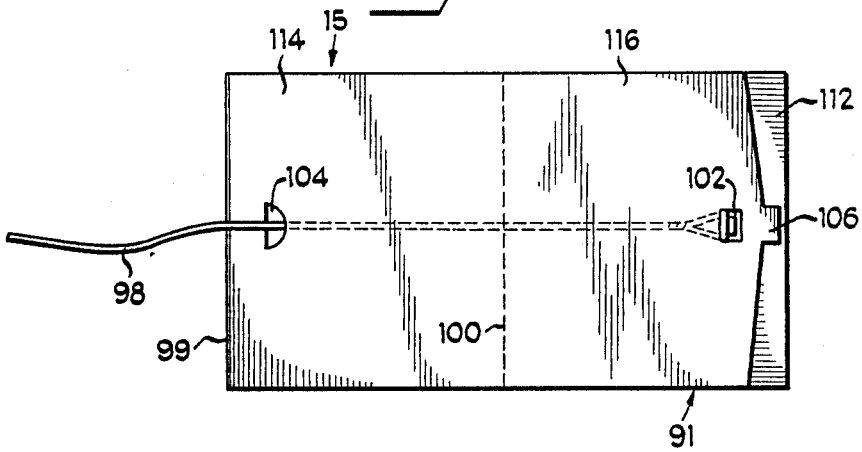
FIG. 18 is a plan view of the embodiment of FIG. 17, showing it in a flat folded position for insertion into a bag prior to expansion.
Figure 19:
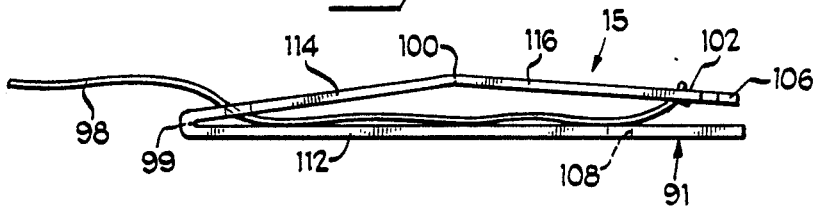
FIG. 19 is a side view of the embodiment of FIG. 17, showing it in a relatively flat, folded position similar to FIG. 18.
Figure 20:
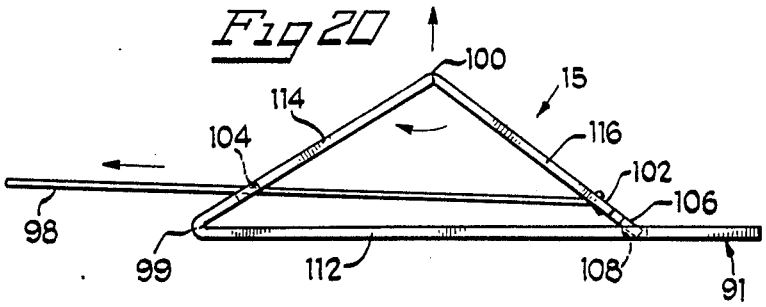
FIG. 20 is a side view of the embodiment of FIG. 17, showing movement of the parts and their relationship to one another when the apparatus is actuated into its position for expanding a bag.

FIGS. 17–20 show a fourth embodiment 15 of the invention. Apparatus 15 is similar to apparatus 13, but does not have sections that are secured to each other by adhesive means. Apparatus 15 has a flat elongate member 91 comprising three sections 112, 114, 116 arranged in tandem and an actuator member 98. As in the other embodiments, member 91 may be constructed of corrugated board, cardboard or other suitable material. Member 98 may be a string, tape, plastic wire, or the like. Sections 112, 114, 116 are formed by fold lines 99, 100 located on member 91. Sections 114 and 116 are adapted to fold about foldline 99 and over onto section 112, as shown in FIGS. 18 and 19. Actuator member 98 is secured to section 116 in slot 102 and extends through an opening 104 in section 114. A tab 106 is provided in section 116 for engaging slot 108 of section 112.

FIGS. 18 and 19 show apparatus 15 as it appears generally flat for insertion into a bag. As shown in FIG.

20, pulling actuator member 98 in the direction of the arrow causes section 116 to move over section 112 and towards section 114. This forms a gable that pushes the sides of a bag outward, and thereby expands the bag. Tab 106 of section 116 engages opening 108 of section 112 and is thereby securely retained, affording stability to apparatus 15. If desired, several openings similar to opening 108 may be added to provide adjustability of the device.

Actuator member 98 can be designed to extend outside of the bag containing apparatus 15 in the same manner as is described for apparatus 13.

Because the inventive apparatus is made from flat paperboard stock or similar material, it may be used for containing printed information 122, such as advertising, bag care instructions, or decorative indicia. In this way, the bag expanding means of this invention can be used to deliver messages to the ultimate purchasers of the bags.

While specific embodiments have been described, all modifications and equivalents of such embodiments which fall within the principles of the invention are intended to be covered by the appended claims; and the claims should therefore be construed to cover all such equivalents falling within the spirit and scope of the invention.

The invention claimed is:

1. A bag expanding device in combination with a soft bag comprising:

a pair of opposed portions partially forming the bag;

means connected between the portions and together with the portions defining a compartment expandable to a predetermined shape;

one or more of the means and the portions being soft and flexible so that the compartment may be readily collapsed into a substantially flattened state or expanded into a substantially stuffed state in which the portions are spaced apart from each other to substantially the full extent permitted by the predetermined shape of the expanded compartment;

the expanding device including a generally planar, rigid insert;

the generally planar, rigid insert being inserted inside the compartment adjacent to one of the portions;

the expanding device also including an expandable piece having a pair of sections foldably attached to each other with each of the sections having a free end spaced from and opposite the free end of the other section;

the sections of the expandable piece being foldable between a first substantially flat coplanar position and a second position in which the sections are substantially parallel to each other;

the expanding device further including a resilient member attached directly to the sections adjacent to the opposite free ends;

the resilient member being in tension when the expandable piece is in the first substantially flat position;

the expandable piece being inserted in the first substantially flat position between the generally planar, rigid insert and the other opposed portion; and the resilient member urging the sections from their relatively flat coplanar position to an intermediate position in which the sections are at an angle to each other and are restrained by the predetermined shape of the expanded compartment.

2. The bag expanding device in combination with a soft bag of claim 1 wherein:

the generally rigid insert and the expandable piece are integral and comprise a relatively flat member being foldable along at least two transverse axes to form a first section, a second section and a third section in tandem;

the first and second sections being the pair of sections;

the third section being the generally rigid insert; and said first and second sections being capable of folding over and overlapping at least a portion of said third section.

3. The bag expanding device in combination with a soft bag of claim 2 wherein said first section includes a tab and said third section includes a slot which is adapted to receive the tab when the first and second sections are formed into a gable and expand the bag.

4. The bag expanding device of claim 2 further comprising:

a second generally planar, rigid insert;

the second generally planar, rigid insert being inserted inside the compartment adjacent to the other opposed portion; and the first and second sections being disposed between the third section and the second generally, planar rigid insert.

5. The bag expanding device in combination with a soft bag of claim 4 in which:

each of the portions has a respective predetermined outline;

the generally planar, rigid insert substantially conforms in outline to the one portion;

the second generally planar, rigid insert substantially conforms in outline to the other opposed portion.

6. The bag expanding device in combination with a soft bag of claim 1 wherein said expandable piece or said generally planar, rigid insert contain printed indicia.

7. The bag expanding device in combination with a soft bag of claim 1 in which the expandable piece is inserted in the first substantially flat coplanar position between the generally planar rigid insert and the other opposed portion of the compartment with the expanding device oriented so that the free ends abut the generally planar, rigid insert when the resilient member urges the sections to the intermediate position.

8. The bag expanding device in combination with a soft bag of claim 1 in which:

each of the portions has a respective predetermined outline; and the generally planar, rigid insert substantially conforms in outline to the one portion.

9. The bag expanding device in combination with a soft bag of claim 1 further comprising:

a second generally planar, rigid insert;

the second generally planar, rigid insert being inserted inside the compartment adjacent to the other opposed portion; and the expandable device being inserted in the first substantially flat coplanar position between the generally planar, rigid insert and the second generally planar, rigid insert.

10. The bag expanding device in combination with a soft bag of claim 9 in which:

each of the portions has a respective predetermined outline;

the generally planar, rigid insert substantially conforms in outline to the one portion; and the second generally planar, rigid insert substantially conforms in outline to the other opposed portion.

11. The bag expanding device in combination with a soft bag of claim 1 further comprising:

a second compartment expandable to a second predetermined shape;

the other opposed portion also partially forming the second compartment;

a third portion of the bag;

second means connected between the opposed portion and the third portion and together with the opposed portion and the third portion defining the second compartment expandable to the second predetermined shape;

one or more of the second means, the opposed portion and the third portion being soft and flexible so that the second compartment may be readily collapsed into a substantially flattened state or expanded into a substantially stuffed state in which the opposed portion and the third portion are spaced apart from each other to substantially the full extend permitted by the predetermined shape of the expanded second compartment;

the expanding device further including a second generally planar, rigid insert;

the second generally planar, rigid insert being inserted inside the second compartment adjacent to the third portion;

the expanding device also including a second expandable piece having a pair of sections foldably attached to each other with each of the sections having a free end spaced from and opposite the free end of the other section;

the sections of the second expandable piece being foldable between a first substantially flat coplanar position and a second position in which the sections are substantially parallel to each other;

the second expanding device further including a resilient member attached directly to the sections adjacent to the opposite free ends;

the resilient member of the second expandable piece being in tension when the second expandable piece is in the first substantially flat position;

the second expandable piece being inserted in the first substantially flat position between the second generally planar, rigid insert and the third portion; and the resilient member of the second expandable piece urging the sections of the second expandable piece from their relatively flat coplanar position to an intermediate position in which the sections are at an angle to each other and are restrained by the predetermined shape of the expanded second compartment.

12. The bag expanding device in combination with a soft bag of claim 11 in which:

each of the portions has a respective predetermined outline;

the generally planar, rigid insert substantially conforms in outline to the one portion;

the third portion has another predetermined outline; and the second generally planar, rigid insert substantially conforms in outline to the third portion.

13. The bag expanding device in combination with a soft bag of claim 11 in which:

the expandable piece is inserted in the first substantially flat coplanar position between the generally planar, rigid insert and the other of the pair of opposed portions of the compartment with the expanding device oriented so that the free ends of the expandable piece abut the generally planar, rigid insert when the resilient member urges the sections to the intermediate position; and the second expandable piece is inserted in the first substantially flat coplanar position between the second generally planar, rigid insert and the opposed portion oriented so that the free ends of the second expandable piece abut the second generally planar, rigid insert when the resilient member of the second expandable device urges the sections to the intermediate position.

14. The bag expanding device in combination with the soft bag of claim 11 further comprising:

a third generally planar, rigid insert;

the third generally planar, rigid insert being inserted inside the compartment adjacent to the other opposed portion; and the expandable device being inserted in the compartment in the first substantially flat coplanar position between the generally planar, rigid insert and the third generally planar, rigid insert.

15. The bag expanding device in combination with a soft bag of claim 14 in which:

each of the portions has a respective predetermined outline;

the generally planar, rigid insert substantially conforms in outline to the one portion;

the third portion has another predetermined outline;

the second generally planar, rigid insert substantially conforms in outline to the third portion; and the third generally planar, rigid insert substantially conforms in outline to the other opposed portion.

* * * * *